US009118118B2

(12) United States Patent
Strickland et al.

(10) Patent No.: US 9,118,118 B2
(45) Date of Patent: Aug. 25, 2015

(54) INCREASED GAIN IN AN ARRAY ANTENNA THROUGH OPTIMAL SUSPENSION OF PIECE-WISE LINEAR CONDUCTORS

(75) Inventors: Peter C. Strickland, Morristown, NJ (US); Hugh Adam Stuart Blackadder, Morristown, NJ (US)

(73) Assignee: EMS Technologies Canada, Ltd., Ottawa, CA (US)

( * ) Notice: Subject to any disclaimer, the term of this patent is extended or adjusted under 35 U.S.C. 154(b) by 527 days.

(21) Appl. No.: 13/501,203

(22) PCT Filed: Mar. 9, 2010

(86) PCT No.: PCT/CA2010/000343

§ 371 (c)(1),
(2), (4) Date: Jun. 28, 2012

(87) PCT Pub. No.: WO2011/044656

PCT Pub. Date: Apr. 21, 2011

(65) Prior Publication Data

US 2012/0256797 A1 Oct. 11, 2012

Related U.S. Application Data

(60) Provisional application No. 61/252,355, filed on Oct. 16, 2009.

(51) Int. Cl.

| | |
|---|---|
| ***H01Q 11/08*** | (2006.01) |
| ***H01Q 1/36*** | (2006.01) |
| ***H01Q 21/06*** | (2006.01) |

(52) U.S. Cl.

CPC ..... *H01Q 11/08* (2013.01); *H01Q 1/362* (2013.01); *H01Q 21/067* (2013.01)

(58) Field of Classification Search

CPC ..... H01Q 1/362; H01Q 11/08; H01Q 21/067
USPC ..... 343/705, 765, 895
See application file for complete search history.

(56) References Cited

U.S. PATENT DOCUMENTS

| | | | |
|---|---|---|---|
| 2,919,442 | A | 12/1955 | Nussbaum |
| 3,510,877 | A | 5/1970 | Turriere |

(Continued)

FOREIGN PATENT DOCUMENTS

| | | |
|---|---|---|
| JP | 227610 | 7/1990 |
| JP | H06029714 | 2/1994 |

(Continued)

OTHER PUBLICATIONS

International Searching Authority, "International Search Report", Mailed Jul. 5, 2010, Published in: WO.

(Continued)

*Primary Examiner* — Robert Karacsony
*Assistant Examiner* — Daniel J Munoz
(74) *Attorney, Agent, or Firm* — Fogg & Powers LLC

(57) ABSTRACT

The present invention provides a high-performance and light-weight helical antenna element and array thereof for use in an aircraft communication system or the like, where stringent spatial restrictions and gain requirements generally apply. The RF performance of the array is enhanced by using ribs and sleeves to reduce the dielectric volume of the support structures of the antenna elements, and by providing apertures within the sleeves of the support structures and between the ribs thereof.

9 Claims, 5 Drawing Sheets

(56) References Cited

U.S. PATENT DOCUMENTS

| | | | | |
|---|---|---|---|---|
| 3,573,840 | A | 4/1971 | Gouillou | |
| 3,852,756 | A | 12/1974 | Reese | |
| 4,427,984 | A | 1/1984 | Anderson | |
| 5,216,436 | A | 6/1993 | Hall et al. | |
| 5,345,248 | A | 9/1994 | Hwang et al. | |
| 5,406,693 | A | 4/1995 | Egashira et al. | |
| 5,479,182 | A | 12/1995 | Sydor | |
| 5,592,184 | A | 1/1997 | Cassel et al. | |
| 5,874,927 | A | 2/1999 | Knowles et al. | |
| 6,172,655 | B1 | 1/2001 | Volman | |
| 6,181,296 | B1 | 1/2001 | Kulisan et al. | |
| 6,664,938 | B2 | 12/2003 | Strickland | |
| 6,819,302 | B2 | 11/2004 | Volman | |
| 6,836,258 | B2 | 12/2004 | Best et al. | |
| 7,142,171 | B1 * | 11/2006 | Patel et al. | 343/895 |
| 2003/0058186 | A1 * | 3/2003 | Saito et al. | 343/895 |
| 2003/0164805 | A1 | 9/2003 | Strickland | |
| 2004/0135732 | A1 | 7/2004 | Volman | |
| 2004/0257298 | A1 * | 12/2004 | Larouche et al. | 343/895 |
| 2005/0078050 | A1 * | 4/2005 | Aisenbrey | 343/895 |
| 2005/0219145 | A1 | 10/2005 | Best et al. | |
| 2007/0072590 | A1 | 3/2007 | Levitan | |
| 2008/0012787 | A1 | 1/2008 | Lamoureux et al. | |
| 2012/0268334 | A1 | 10/2012 | Strickland et al. | |
| 2012/0280875 | A1 | 11/2012 | Sutherland et al. | |

FOREIGN PATENT DOCUMENTS

| | | |
|---|---|---|
| JP | 2004120168 | 4/2004 |
| JP | 2005-072873 | 3/2005 |
| JP | 2005159725 | 6/2005 |

OTHER PUBLICATIONS

European Patent Office, "Communication under Rule 71(3) EPC", "from Foreign Counterpart of U.S. Appl. No. 13/501,199", Jun. 11, 2013, pp. 124, Published in: EP.

Kraus et al., "Antennas 3rd edition, Chapter 8 'The Helical Antenna: Axial and Other Modes, Part II'", 2002, pp. 250-303, Publisher: McGraw-Hill.

European Patent Office, "Office Action", "from Foreign Counterpart of U.S. Appl. No. 13/501,203", Mar. 8, 2013, pp. 15, Published in: EP.

Japanese Patent Office, "Office Action from JP Application No. 2012-533438 mailed Mar. 7, 2014", "from Foreign Counterpart of U.S. Appl. No. 13/501,203", Mar. 7, 2014, pp. 1-4, Published in: JP.

European Patent Office, "Office Action", "from Foreign Counterpart of U.S. Appl. No. 13/501,194", Mar. 13, 2013, pp. 1-5, Published in: EP.

European Patent Office, "European Search Report", "from Foreign Counterpart of U.S. Appl. No. 13/501,194", Feb. 26, 2013, pp. 1-2, Published in: EP.

European Patent Office, "European Search Report", "from Foreign Counterpart of U.S. Appl. No. 13/501,199", Feb. 26, 2013, pp. 1-3, Published in: EP.

European Patent Office, "European Search Report", "from Foreign Counterpart of U.S. Appl. No. 13/501,203", Feb. 26, 2013, pp. 1-3, Published in: EP.

Hui et al., "The input impedance and the Antenna Gain of the Spherical helical Antenna", "IEEE Transactions on Antennas and Propogation", Aug. 2001, pp. 1235-1237, vol. 49, No. 8.

Kraus, "Table of Pattern, Beam Width, Directivity, Terminal Resistance", Jan. 1, 1950, pp. 212-217.

Japanese Patent Office , "Office Action from JP Application No. 2012-533437 mailed Mar. 7, 2014", "from Foreign Counterpart of U.S. Appl. No. 13/501,194", Mar. 7, 2014, pp. 15, Published in: JP.

Japanese Patent Office, "Office Action from JP Application No. 2012-533439 mailed Mar. 7, 2014", "from Foreign Counterpart of U.S. Appl. No. 13/501,199", Mar. 7, 2014, pp. 1-3, Published in: JP.

U.S. Patent and Trademark Office, "Office Action", "from U.S. Appl. No. 13/501,199", Mar. 20, 2014, pp. 1-40, Published in: US.

European Patent Office, "Communication under Rule 71(3) from EP Application No. 10822926.1 mailed Feb. 26, 2014", "from Foreign Counterpart of U.S. Appl. No. 13/501,203", Feb. 26, 2014, pp. 1-7, Published in: EP.

U.S. Patent and Trademark Office, "Office Action", "from U.S. Appl. No. 13/501,194", Jul. 17, 2014, pp. 1-38, Published in: US.

U.S. Patent and Trademark Office, "Notice of Allowance", "from U.S. Appl. No. 13/501,194", Feb. 2, 2015, pp. 1-12, Published in: US.

U.S. Patent and Trademark Office, "Final Office Action", "from U.S. Appl. No. 13/501,199", Feb. 9, 2015, pp. 1-29, Published in: US.

Japanese Patent Office, "Office Action from JP Application No. 2012-533438 mailed Dec. 5, 2014", "from Foreign Counterpart of U.S. Appl. No. 13/501,203", Dec. 5, 2014, pp. 1-4, Published in: JP.

* cited by examiner

INCREASED GAIN IN AN ARRAY ANTENNA THROUGH OPTIMAL SUSPENSION OF PIECE-WISE LINEAR CONDUCTORS

This application claims priority to International Patent Application No. PCT/CA2010/000343 filed on Mar. 9, 2010, which claims priority to U.S. Provisional Patent Application No. 61/252,355 filed on Oct. 16, 2009.

FIELD OF THE INVENTION

The present invention pertains to the field of antennas, and in particular, to helical antenna elements and arrays thereof.

BACKGROUND

A helical antenna array generally comprises a series of helical antenna elements, each one of which comprising a conductor, such as a wire, tape, moulded conductor, stamped conductor, extrusion, or printed circuit, having a nominally helical geometry that, when energized, generates a circularly or substantially circularly polarized beam. In some realisations the helices may have more than one winding, where the windings may have the same or different pitches and the same or different starting positions. To ensure structural integrity, the helical winding is usually supported by a dielectric former consisting of a cylinder or the like, and as such has a substantially circular helix cross-section. Helical antenna arrays may further comprise a ground plane, which provides a signal return or ground connection for the RF source of the antenna elements, and can further reflect that part of the electromagnetic wave generated by the antenna elements that propagates in the rearward direction, i.e. the ground plane effectively re-directs this radiation forwards. The live terminal of the RF source, on the other hand, connects to the starting point of the antenna's helical winding, which in some cases lies proximal to or almost immediately above the ground plane. Thus, the ground plane may provide circuit continuity for the input transmission line, usually a coaxial cable, which excites the antenna. For example, the center conductor of the coaxial line connects to the end of the helical winding, whereas the outer conductor of the coaxial line connects to the ground plane. The ground plane may have a planar surface, or alternatively, may consist of a cup, as shown in U.S. Pat. No. 6,664,938. In some realisations there may be no ground plane with the wave being launched either between adjacent windings or at a point along one or more windings.

The performance of relatively small helical antenna elements can be characterized, at least in part, by a gain parameter, which usually ranges from 5 to 12 dBIc. While in some cases, higher gain levels in excess of 12 dBIc can be achieved by using longer helices, significantly large length increments are often required to achieve relatively small gain increments. Therefore, a helix antenna is generally considered to be more efficient in terms of gain achieved as related to structural volume, when it is relatively short. For many purposes, a more expedient solution to achieving higher gains is to assemble an array of moderately sized helices.

In some applications, such as those shown in US Patent Application Publication No. 2008/0012787, a helical antenna element may have a conical shape, where the winding diameter at the feed end of the winding may be greater than the diameter at the radiating end. Conical helix structures may be advantageous when a helix antenna is to be operated over a wide frequency band. In other applications, such as the ones shown in U.S. Pat. No. 6,172,655 and US Patent Application Publication No. 2004/0135732, helices are wound about formers of varying cross-section diameters, increasing linearly toward a central maximum, and reducing linearly thereafter. Antenna elements of this type are commonly known in the art to provide for increased broadband performance. These examples may further comprise varying helix winding densities, wherein a winding has smaller pitches at the feed end and larger pitches at the radiating end.

As will be appreciated by the person of ordinary skill in the art, a helix is generally excited by connecting the lower extremity of its winding to an RF source. An electromagnetic wave then travels around the winding. This wave ultimately launches radiated fields when it arrives at the top the radiating or terminal end of the winding. A major portion of the radiated fields then propagates forwards, following a direction that is dictated predominantly by the phase distribution of the wave along the helix winding. In the design of high gain, fixed beam arrays, it is generally desirable to design the individual helices for maximum gain along the axis of the helix winding.

Many factors may contribute to the reduction of the gain of a helical antenna: the termination of the antenna, if open-circuited, carries no current; the dielectric material of the support structure may introduce dissipative losses and stored energy with related mismatch losses; mutual coupling between adjacent helices can broaden the beam; the axial design of conventional helices makes inefficient use of the volume within which the antenna may be rotated; and the high launching impedance resulting from small winding diameters can result in an inferior matching structure.

When several helices are assembled together so as to form an array, electromagnetic couplings may occur between neighbouring helices. Conventional excitation of the array with uniform helix orientations exacerbates this problem by maximising the coupling between the elements. One impact of the coupling is to progressively pull the patterns of the individual elements towards the centre of the array. The individual elements of the array then radiate in different directions, thereby reducing the gain of the array. Additionally, the coupling narrows the impedance bandwidth, and may increase mismatch loss. For example, in a four-element array comprising non-helical elements, a power gain of roughly 5 dB can be achieved using the array, over the gain of a single element. Given the electromagnetic couplings between helix elements, however, a four-element helix array is more likely to have a power gain of only 4 dB higher than that of a single helix element.

U.S. Pat. No. 5,874,927 provides one approach to improving the performance of a helical antenna array by tilting the otherwise linear helical antenna elements away from one another, whereby such tilting is reported to broaden the effective aperture of the array. This approach, while providing some advantages over parallel implementations, also has the effect of increasing the overall sweeping radius of the array, which, in some embodiments where spatial limitations are of crucial importance, can limit the applicability of such design.

For example, helical antenna arrays are commonly used for satellite communications in aircrafts or the like. Examples of satellite communications may include, but are not limited to, airborne and/or ground based communications for receiving weather reports and/or air traffic control information, or for communicating status and emergency messages, to name a few. Furthermore, such satellite communication systems may also be useful in providing such services as telephone communications, Internet services, and/or other forms of data exchange to the aircraft passengers. In the context of aircraft communications, helical antenna arrays are commonly mounted at the tail section of an airplane or the like, which tends to be very narrow and may limit the size of the antenna array that can be deployed. Consequently, a person of ordinary skill in the art would appreciate that the installation and operation of a helical antenna array for aircraft communications may impose certain operational and structural limitations to the type of antenna suitable for such applications.

Furthermore, as aircraft communication systems generally relay communications via a link from the aircraft to a communications satellite, which communications are then relayed to grounded resources via a separate link, and since such systems are generally expected to function independently of the position of the aircraft around the globe, the associated aircraft communications antenna should generally be capable of pointing its radiation towards a selected satellite at all times. Accordingly, the antenna beam should be steered by appropriate means depending on the local latitude and longitude of the aircraft, the attitude of the aircraft, and the heading of the aircraft. In some applications, an electronic steering method is used to reduce the number of mechanically moving or turning parts of the antenna structure. However, such steering methods generally are not applied to single helix implementations. Rather, mechanical steering methods may be used alone or in combination with electronic steering. As noted above, however, the aircraft may impose certain limitations relating to the available spaces within which the antenna can be installed and operated (i.e. steered). These limitations place very demanding constraints on the size of the antenna assembly, and the scan envelope volume that the antenna assembly requires. For instance, in order to mechanically steer the antenna within the tail section of the aircraft to scan a desired coverage area, spatial limitations should generally be respected irrespective of antenna orientation, namely, the antenna should operate freely within a scan radius or volume as prescribed by a radome covering a top portion of the aircraft tail section and the antenna in operation. Similarly, radomes on top of trucks, trains, ships, fuselages and other vehicles are compact and may limit the sweeping volume of the antenna installed.

Accordingly, solutions as provided by U.S. Pat. No. 5,874,927, while providing some operational advantages over standard arrays, may be of limited suitability in the above context where spatial limitation applies, or where an increase to an array sweep radius cannot generally be accommodated in standard installations.

Therefore there is a need for a new helical antenna element and array thereof that overcomes some of the drawbacks of known antenna arrays, or that provides the public with a useful alternative.

This background information is provided to reveal information believed by the applicant to be of possible relevance to the present invention. No admission is necessarily intended, nor should be construed, that any of the preceding information constitutes prior art against the present invention.

SUMMARY

An object of the invention is to provide a helical antenna element and array thereof. In accordance with one aspect of the invention, there is provided an antenna comprising: a ground plane; and an army of helical antenna elements, each one of which comprising a support structure and a conductor helically supported thereby defining respective element axes extending from said ground plane in a direction substantially perpendicular thereto, the helical antenna element having a terminal end and having a base end mounted to the ground plane; wherein the support structure of at least one helical antenna element comprises a series of support ribs extending substantially radially outward from an internal, hollow, dielectric cylinder, the support ribs comprising a series of substantially parallel longitudinal ribs symmetrically circumscribing the support structure. According to this aspect of the invention, at least one said support structure comprising a plurality of support ribs extending substantially radially from a thin-walled dielectric cylinder with the said conductor disposed about the ribs.

In accordance with another aspect of the invention, there is provided an antenna comprising: a ground plane; and an array of helical antenna elements, each one of which comprising a dielectric support structure and a conductor helically supported thereby defining respective element axes extending from said ground plane in a direction substantially perpendicular thereto; at least one said support structure having a plurality of ribs for supporting said conductor, and apertures defined therein between said ribs.

In accordance with another aspect of the invention, there is provided an antenna comprising: a ground plane; and an array of helical antenna elements, each one of which comprising a support structure and a conductor helically supported thereby defining respective element axes extending from said ground plane in a direction substantially perpendicular thereto; at least one said support structure comprising a substantially longitudinal dielectric sleeve about which said conductor is wound, said sleeve having defined therein a plurality of apertures, whereby provision of said apertures allows a structural integrity of said structure to be maintained while reducing, in operation, dielectric loading and losses induced by said support structure.

In accordance with another aspect of the invention, there is provided an antenna comprising: a ground plane; and an array of helical antenna elements, each one of which comprising a support structure and a conductor helically supported thereby defining respective element axes extending from said ground plane in a direction substantially perpendicular thereto; wherein said respective axes are disposed nominally about a circle; and wherein element orientations are rotated about their axes, each relative to the next, introducing an increase in space between the feed points.

In accordance with another aspect of the invention, any one of the above antennae may be used in an aircraft communication system.

In accordance with another aspect of the invention, any one of the above helical antenna elements may be used in the manufacture of a helical antenna array.

Other aims, objects, advantages and features of the invention will become more apparent upon reading of the following non-restrictive description of specific embodiments thereof, given by way of example only with reference to the accompanying drawings.

DETAILED DESCRIPTION

Figure 1:
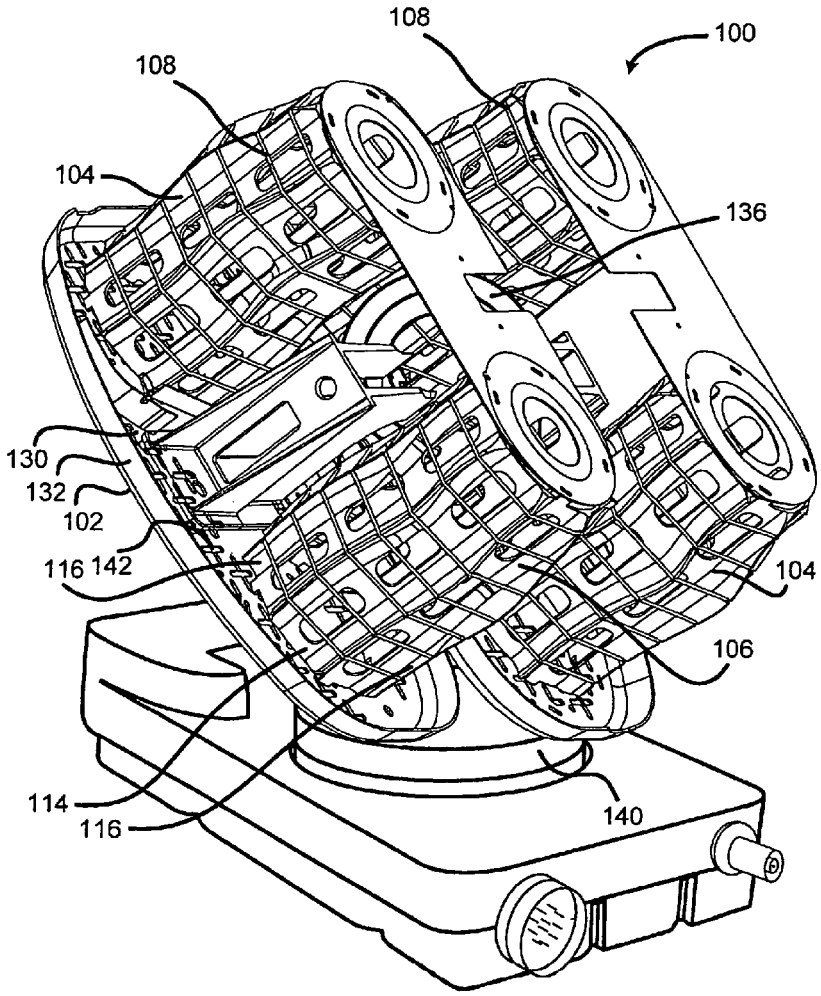
FIG. 1 is a perspective view of a helical antenna array, in accordance with one embodiment of the invention.
Figure 2:
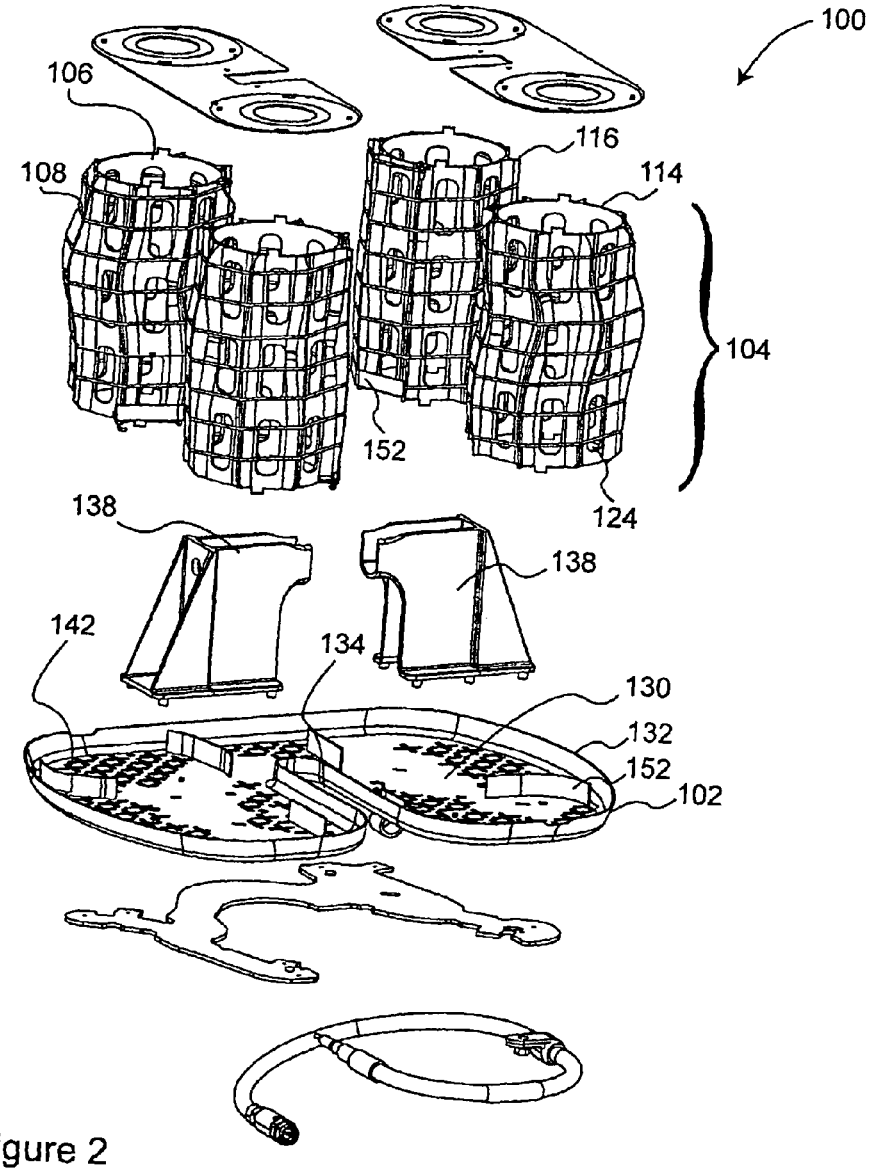
FIG. 2 is an exploded view of the antenna array of FIG. 1, showing a top down perspective of components thereof, and an optional off-axis conductive loading plate shown in relation to an antenna element thereof.
Figure 3:
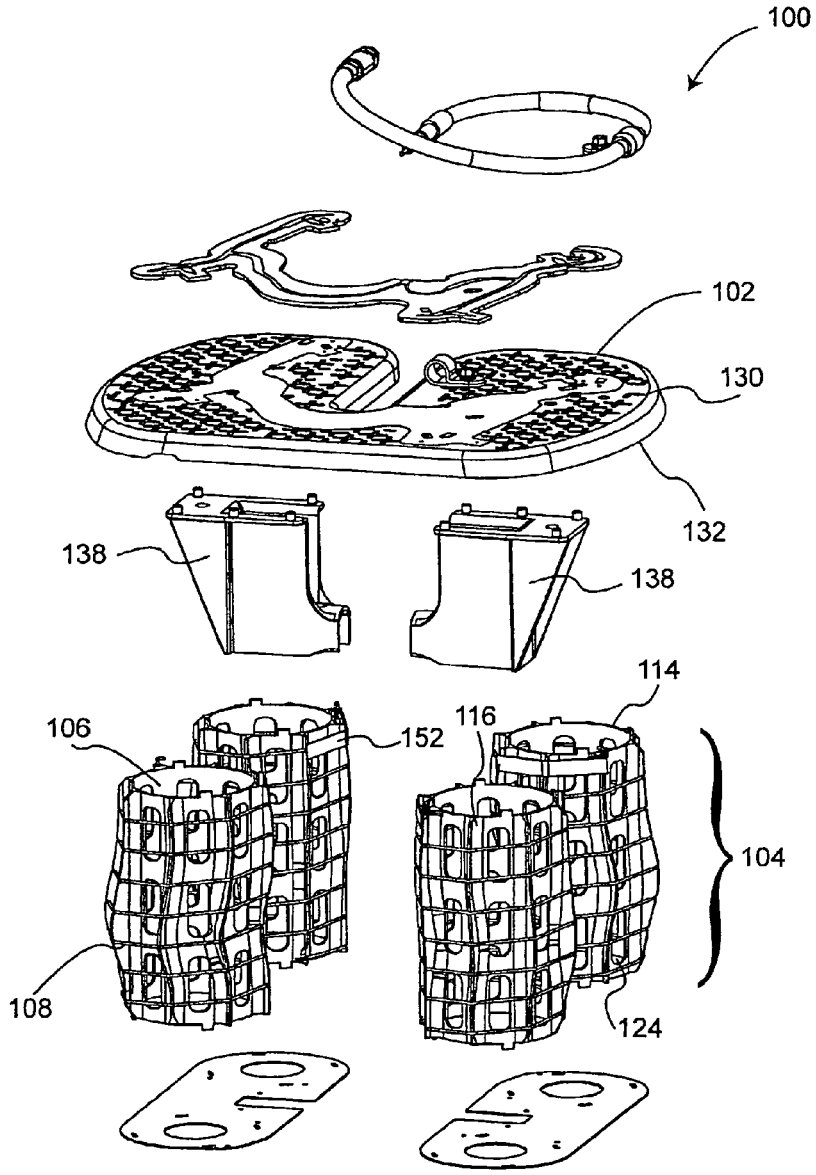
FIG. 3 is an exploded view of the antenna array of FIG. 1, showing a bottom up perspective of components thereof.
Figure 4:
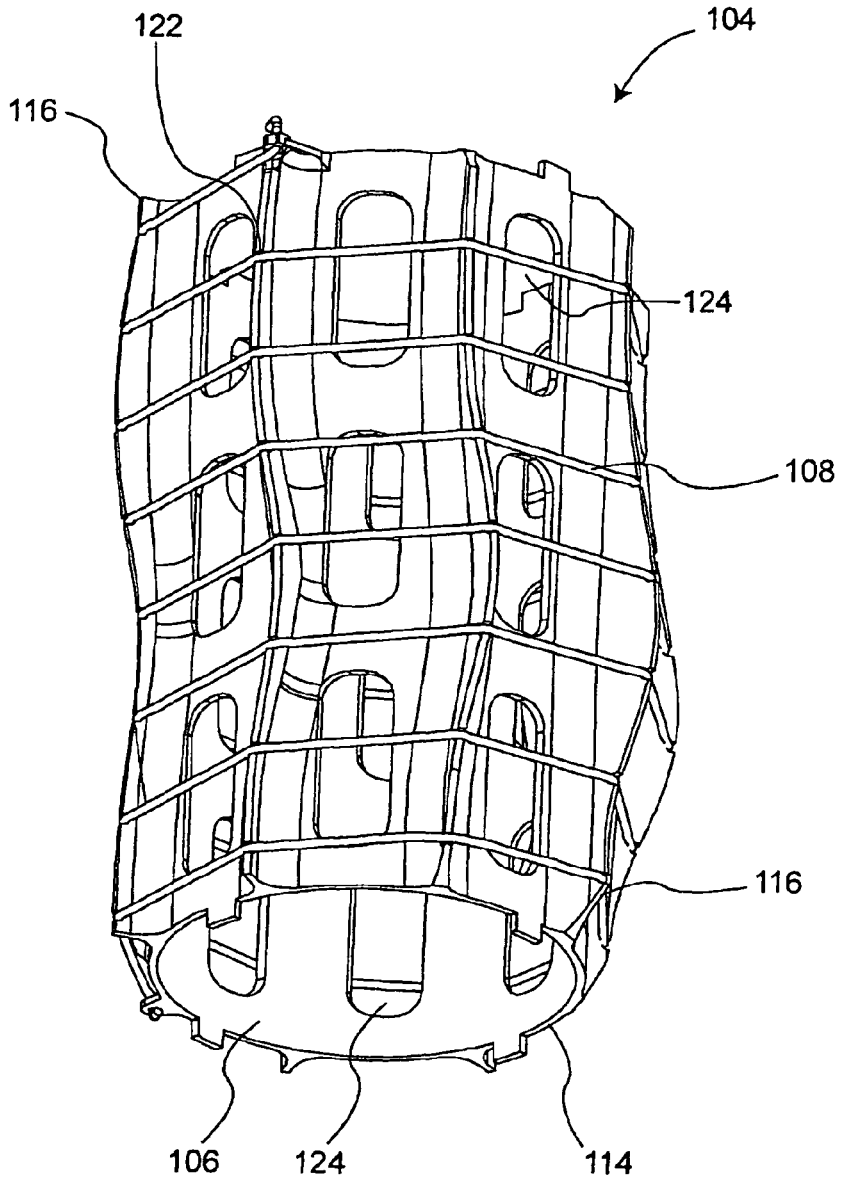
FIG. 4 is a perspective view of an antenna element of the antenna array of FIG. 1.

Unless defined otherwise, all technical and scientific terms used herein have the same meaning as commonly understood by one of ordinary skill in the art to which this invention belongs.

The following provides a description of a helical antenna array, and antenna elements thereof, in accordance with different embodiments of the invention. In general, the array will comprise a ground plane and an array of helical antenna elements, each one of which comprising a support structure and a conductor helically supported thereby defining respective element axes extending from said ground plane in a direction substantially perpendicular thereto. For example, different embodiments may comprise two, four or more helical antenna elements, which, depending on the embodiment and the application for which the array is intended, may be substantially identical elements, or structurally or operationally different elements.

As will be appreciated by the person of skill in the art, different embodiments may be designed and used for different applications. For instance, and as introduced above, helical antenna arrays are commonly used for satellite communications, which may include but are not limited to ground and/or airborne satellite communications, such as described above in the context of aircraft communications. Clearly, while some of the embodiments described below may be particularly amenable for use in aircraft communication systems, these embodiments are not intended to be limited as such, as the features of these embodiments, and the operational improvements and/or advantages provided thereby, may be equally applicable in other contexts where helical antenna arrays are commonly used, as will be appreciated by the person of ordinary skill in the art. For the purpose of the following description, however, the embodiments of the invention will be described within the context of aircraft communications, and particularly, wherein an antenna array is generally mounted for operation within the limited spatial confines of a radome or the like, as commonly found at the tail end of an aircraft, and wherein operation of the antenna array requires a certain level of spatial freedom in allowing the array to sweep a suitable scan area to provide suitable coverage. Accordingly, in accordance with some embodiments, improvements in the performance of the antenna array are provided in comparison with traditional arrays having similar spatial dimensions or profiles, thereby providing a potential replacement for traditional arrays without imposing changes to existing spatial restrictions for such antennas.

For instance, and in accordance with some embodiments of the invention, the antenna array may incorporate one or more of the below-described modifications, which, alone or in different combinations, may increase the overall gain in the array, reduce dissipative losses in the array, or improve the array's manufacturability. In the context of a steerable antenna in aircraft communication systems, where a helix array may be subject to continuous reorientation by tilting the array and its beam so that it can be pointed in different directions, these modifications may, in accordance with different embodiments, allow for maintaining an overall sweeping volume of the antenna array while achieving higher gains. Further, the antenna structure can generally be rotated about each of two orthogonal axes in order to synthesize volumetric coverage. In some embodiments, each axis passes through the centre of the antenna structure, thereby reducing the scan envelope of the array, i.e. the single envelope that contains the antenna assembly in all its various different scan orientations; this scan envelope will thus fix the minimum size of the radome structure within which the antenna components can be housed. On an aircraft, there are generally many hard limitations relating to the available spaces within which the antenna can be installed; therefore, achieving significant operational gains without significantly increasing the overall antenna structure can provide significant advantages in this field. As indicated above, however, the operational gains achieved by the embodiments of the invention herein described are equally applicable in other contexts where structural size limitations are not as strictly applicable.

It will be appreciated that the examples provided below describe, in accordance with different embodiments of the invention, different features, which, alone or in combination, can allow for an improved helical antenna array performance. Accordingly, the person of skill in the art will appreciate that while different features are combined in describing a same exemplary embodiment, these features may be equally considered alone or in different combinations to provide different desirable effects without departing from the general scope and nature of the present disclosure.

Referring now to FIGS. 1 to 4, and in accordance with one exemplary embodiment of the invention, a helical antenna array, generally referred to using the numeral 100, will now be described. As shown in these Figures, the array 100 generally comprises a ground plane 102 and four substantially identical antenna elements 104, each one of which extending substantially perpendicularly from the ground plane and comprising a support structure 106 and a conductor 108 (e.g. conductive wire) helically supported thereby. It will be appreciated that while four antenna elements are depicted herein, different numbers of antenna elements may be considered herein without departing from the general scope and nature of the present disclosure. Namely the four-element examples depicted herein are meant as exemplary only, as the features described herein may be equally applicable to other arrays comprising two, three, four or more antenna elements.

Furthermore, and in accordance with one embodiment, each support rib 116 may further comprise a series of notches or indentations 122 for receiving and thereby supporting the conductor 108.

In some embodiments, the provision of a rib-based former may provide for reduced mass and an improved RF performance due to a reduction in dielectric volume, and displacement of dielectric from the helix winding. The reduction in dielectric volume may further alleviate the otherwise perturbing propagations of electromagnetic fields around the winding. To enhance these positive effects, a series of apertures (i.e. windows) 124 may be provided within the sleeve 114 between the support ribs 116 to further reduce the mass and dielectric volume of the antenna element, thereby reducing dielectric loading and losses induced by the provision of the former.

Referring now to FIGS. 1 to 4, the antenna array 100, in accordance with one embodiment of the invention, further comprises a number of additional features, which, alone or in combination, may allow for an improvement in array performance.

For example, the ground plane 102 generally comprises a conductive sheet 130 or the like upon which the antenna elements 104 are mounted. As depicted in FIGS. 1 to 4, the ground sheet 130 extends laterally to define the base of the array, and terminates along its edges in a raised lip 132. The ground plane 102 may be shaped to define a notch 134 through which a suitable dielectric spar 136 may be introduced for cooperative coupling to an array mounting structure 138 provided on the ground plane 102. The spar may allow for operative coupling of the array to a drive mechanism configured for rotating the array about an axis thereof. For example, the present embodiment allows for the array to rotate about a lateral axis located through a geometrical centerline of the array such that the rotation thereabout does not outwardly extend the sweeping envelope of the array. The present embodiment also allows for the array to longitudinally rotate about a perpendicular axis defined by a corresponding geometrical centerline of the array. The longitudinal rotation may be implemented through a rotation platform 140 upon which the spar 136 is mounted. Accordingly, the combined mechanism allows for a reorientation of the antenna array 100 about orthogonal axes within a prescribed sweeping envelope substantially defined by the diameter of the base plane 102 and the diameter of the array at the terminal end of the helical antenna elements 104. For this purpose, the outer edge of the ground plane may be appropriately shaped to allow for the rotation of the four-helix array without mechanical interference with the scanning mechanism.

In another embodiment, one or more ground cups, rather than a single ground plane, may be used to provide, in some implementations, for greater efficiency and gain.

In another embodiment, the spar 136 is manufactured of a dielectric material incorporating one or more air pockets as a means for reducing the amount of dielectric material within the array volume and thus reducing the potential impact that the spar may have on array performance.

In another embodiment, the base plane 102 may further comprise a series of apertures defined therein, such as apertures 142, wherein the dimension of these apertures allows one or more bands of electromagnetic field frequency to pass through the plane 102 with reduced attenuation comparing with a similar plane devoid of such apertures.

With reference to FIGS. 1 to 4, the helix windings, depicted herein as helically wound conductive wires 108, may further have electrically coupled thereto, respective conductive strips attached along a section of these wires as a means of increasing capacitive loading, thereby facilitating impedance matching. For example, in this embodiment, one or more conductive strips 152 are provided toward the feeding ends of the helical windings. A person of ordinary skill in the art will nonetheless appreciate that further or alternative conductive members may be disposed about the helical windings to provide similar effects.

Still referring to FIGS. 1 to 4, the nominal helix axes may further be rotated relative to each other such that the space between their respective feed points is increased for reduced coupling and increased array gain.

Figure 5:
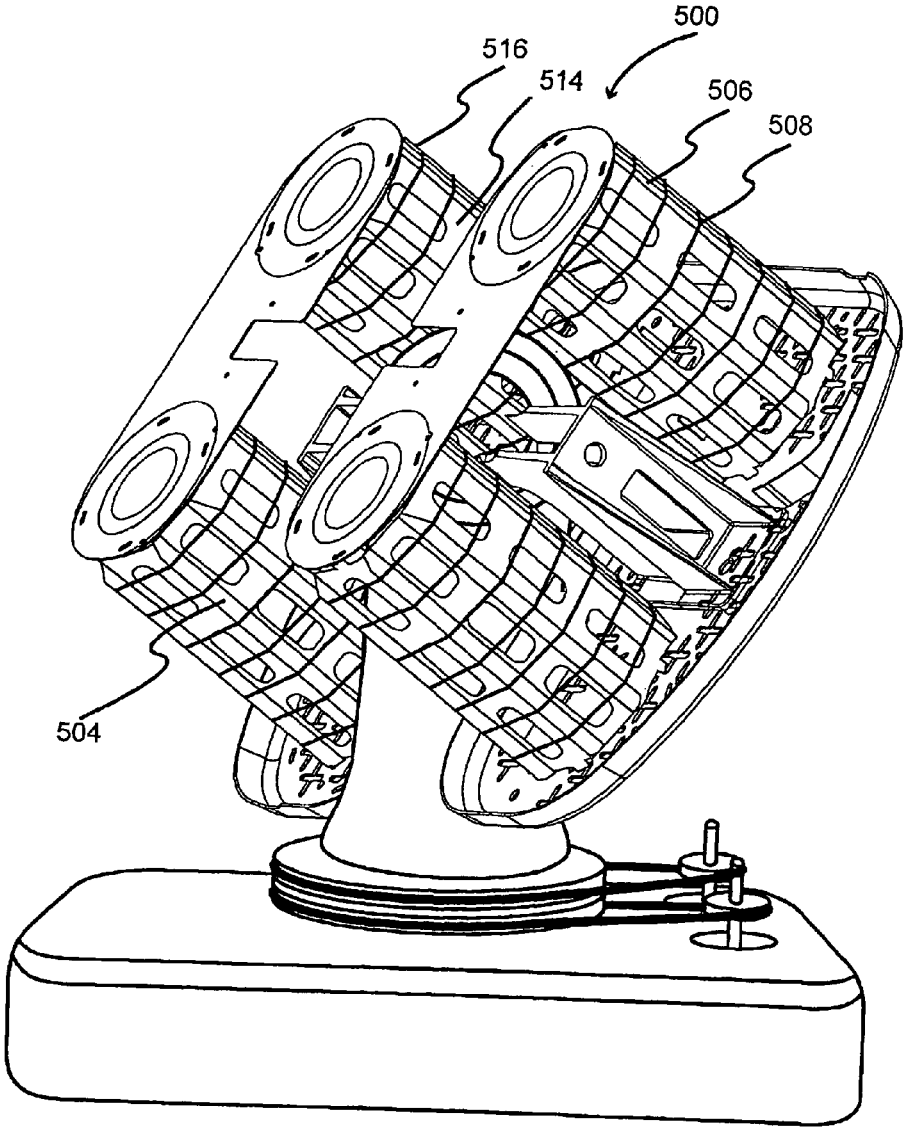
FIG. 5 is a perspective view of a helical antenna array, in accordance with another embodiment of the invention.

Referring now to FIG. 5 and in accordance with another embodiment of the invention, an alternative helical antenna array 500 will now be described, wherein like reference numerals are used to describe similar parts. In this embodiment, four linear helical antenna elements 504 are provided, each one of which comprising a substantially linear former 506 about which a conductor, such as a wire 508, is helically disposed. Like the embodiments of FIGS. 1 to 4, the former 506 comprises a nominally cylindrical sleeve 514 having a series of radially extending ribs 516 upon which the winding conductor 508 is mounted thereby defining a substantially piece-wise linear configuration.

It is apparent that the foregoing embodiments of the invention are exemplary and can be varied in many ways. Such present or future variations are not to be regarded as a departure from the spirit and scope of the invention, and all such modifications as would be obvious to one skilled in the art are intended to be included within the scope of the following claims.

We claim:

1. An antenna comprising:

a ground plane; and an array of helical antenna elements, each helical antenna element comprising a non-conductive support structure and a conductor helically supported thereby defining respective element axes extending from the ground plane in a direction substantially perpendicular thereto, the helical antenna element having a terminal end and having a base end mounted to the ground plane;

wherein the non-conductive support structure of at least one helical antenna element comprises a series of support ribs extending substantially radially outward from an internal, hollow, dielectric cylinder, the support ribs comprising a series of substantially parallel longitudinal ribs symmetrically circumscribing the support structure;

wherein the conductor of the at least one helical antenna element is disposed about the support ribs to define a substantially piece-wise linear conductive helix, wherein portions of the at least one helical antenna element linearly extend between the support ribs;

wherein the non-conductive support structure of the at least one helical antenna element has a plurality of ribs for supporting the conductor of the at least one helical antenna element, and has apertures defined therein between said ribs.

2. The antenna of claim 1, wherein the conductor of the at least one helical antenna element comprises a plurality of arcuate segments.

3. The antenna of claim 1, wherein each support rib comprises a plurality of notches for receiving and thereby supporting the conductor of the at least one helical antenna element.

4. The antenna of claim 1, wherein the substantially piece-wise linear conductive helix defines a substantially polygonal element cross-section.

5. The antenna of claim 1, wherein the conductor of the at least one helical antenna element comprises a conductive wire.

6. The antenna of claim 1, wherein one or more respective axes of the helical antenna elements are rotated relative one to another thereby distancing respective feed points thereof and reducing the coupling between the helical antenna elements.

7. The antenna of claim 1, further comprising an antenna orientation mechanism for orienting the antenna about at least one axis of rotation, wherein a sweeping envelope of the antenna about the at least one axis is defined by at least one of a base plane dimension and a combined dimension of antenna element terminal ends.

8. The antenna of claim 7, wherein the antenna orientation mechanism is further for orienting the antenna about two substantially orthogonal axes.

9. The antenna of claim 8, wherein the antenna is dimensioned to be mounted within a radome such that the sweeping envelope of the antenna is contained within the radome.

* * * * *